United States Patent [19]

Hengelmolen

[11] Patent Number: 4,715,584

[45] Date of Patent: Dec. 29, 1987

[54] FURNACE FOR MELTING METALS

[75] Inventor: Andrianus J. Hengelmolen, Dreumel, Netherlands

[73] Assignee: Hengelmolen Engineering B.V., Dreumel, Netherlands

[21] Appl. No.: 573,570

[22] Filed: Jan. 25, 1984

[30] Foreign Application Priority Data

Jan. 26, 1983 [NL] Netherlands ..... 8300288

[51] Int. Cl.[4] ..... C21C 5/38

[52] U.S. Cl. ..... 266/155; 266/156

[58] Field of Search ..... 266/155, 156, 159, 89

[56] References Cited

U.S. PATENT DOCUMENTS

| | | | |
|---|---|---|---|
| 1,401,222 | 12/1921 | Wiberg | 266/155 |
| 1,814,567 | 7/1931 | Merkt | 266/155 |
| 2,522,576 | 9/1950 | Ingraham | 266/156 |
| 2,988,442 | 6/1961 | Tanner | 266/156 |
| 3,220,826 | 11/1965 | Okaniwa et al. | 266/89 |
| 3,645,516 | 2/1972 | Turpin et al. | 266/901 |
| 3,963,416 | 6/1976 | Mach | 266/155 |
| 3,997,299 | 12/1976 | von Linde et al. | 266/156 |
| 4,328,030 | 5/1982 | Tozaki et al. | 266/156 |

FOREIGN PATENT DOCUMENTS

| | | | |
|---|---|---|---|
| 0042147 | 12/1981 | European Pat. Off. | 266/156 |

*Primary Examiner*—L. Dewayne Rutledge
*Assistant Examiner*—S. Kastler
*Attorney, Agent, or Firm*—Bernard, Rothwell & Brown

[57] ABSTRACT

A furnace for melting metals, in which the heating of the metal to be molten takes place at least partly by conducting hot gases along this metal. Means are provided for recycling the hot gases through the furnace chamber. The gases are either combustion gases of a burner disposed in the furnace chamber, or an inert gas heated outside the furnace chamber.

4 Claims, 2 Drawing Figures

FIG. 1
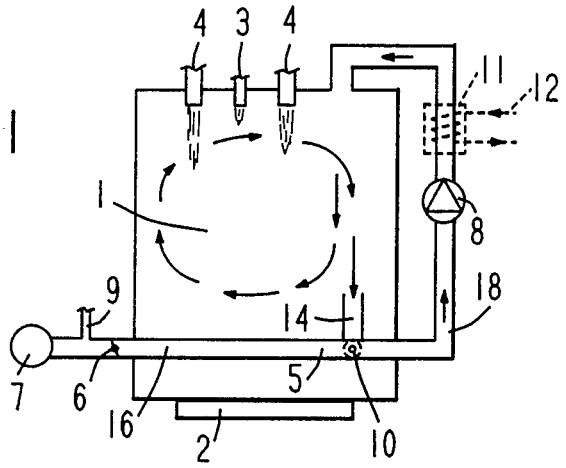
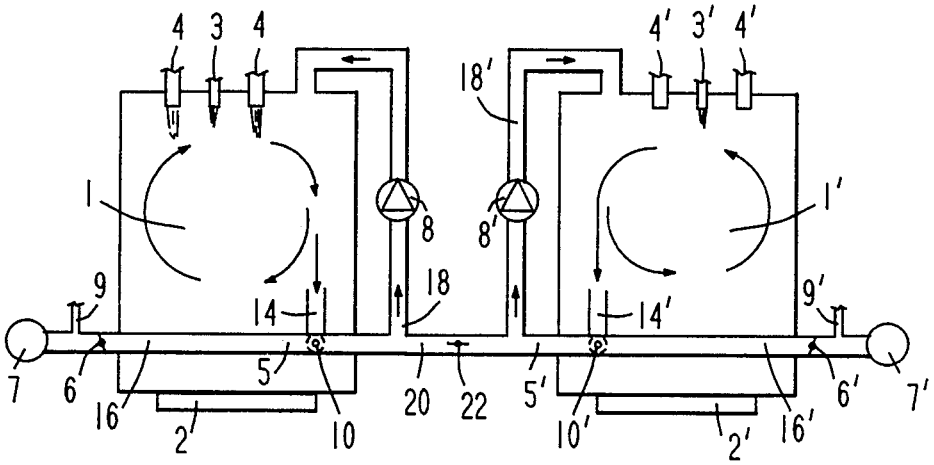
FIG. 2

FURNACE FOR MELTING METALS

The invention relates to a furnace for melting metals, comprising a furnace chamber having at least one closable supply opening for the metal to be molten, at least one heat source and means for discharging gases.

In furnaces for melting metals, for the purpose of limiting loss of energy, the means for discharging the gases which, in a furnace having a burner or burners positioned in the furnace chamber are the combustion gases, are often fitted with means withdrawing a maximum quantity of heat from these combustion gases.

The heat withdrawn can be used either for pre-heating the combustion air for the burner or burners in the furnace, or for heating water, which hot water can be used for various purposes.

A drawback going with this method of recovering heat from the combustion gases is that the efficiency is relatively low—in practice a saving in energy of 15–25% can be realized—and that in particular the pre-heating of the combustion air for the burner requires an expensive burner specially suitable for the use of the preheated combustion air.

The processing of enamelled metal or metal contaminated with oil residues or metal with other contaminants, e.g. synthetic plastics, is possible in existing furnaces, such a rotary kilns, with or without the use of salt. Mutual chemical reactions between organic components with metal, however, mostly result in increased loss of metal due to slag formation. Moreover, in particular when melting scrap of a slight material thickness, a substantial loss of efficiency is encountered due to the relatively large surface area of the metal to be molten as a result of the oxidation of the metal surface under the influence of the air in the furnace chamber.

It is an object of the invention to provide a furnace devoid of the above drawbacks and wherein the organic components, if any, can be pyrolyzed, wherein the metal may be preheated and wherein the metal can be molten, while each of these steps can be effected separately as well as two or three of these steps jointly in the furnace, in which latter case, a batch once introduced in the furnace need not be transferred to another space for a subsequent process phase.

To this end, the invention provides a furnace of the above type in which the means for discharging gases are connected to a conduit for recycling at least a part of these gases to the furnace chamber.

The invention is based on the insight that, for melting metals with a minimum quantity of energy and for an optimum yield of molten metal, it is desirable to heat the metal to be molten as much as possible by means of oxygen-deficient hot gases and to allow minimal direct contact of the metal with the flames of the burner, since direct flame contact with the metal practically always leads to increased oxidation.

According to a first embodiment of the furnace according to the invention, the gases recycled through the furnace chamber are the combustion gases of the burners, while according to a second embodiment, the recycled gas is an inert gas which is heated outside the furnace chamber by means of a heating element, e.g. a heat exchanger. The advantage of the use of inert gas is that the oxidation of the metal to be molten can be further suppressed.

In the furnace according to the invention, it is desirable to keep the flames of the burner or burners, if positioned on the furnace chamber, as short as possible, or to position the burner(s) elsewhere in the system. The heating of the metal to be molten need not take place by one or more burners on the furnace chamber or elsewhere in the system; it is also possible to effect indirect heating by means of a heat exchanger heated by one or more burners, while finally, also electric heating can be used. It has also been found that as small a temperature difference as possible between the heat-transferring medium and the metal to be molten is favourable for obtaining a minimum quantity of metal oxide and hence a maximum yield.

By recycling, according to the invention, at least a part of the hot grass, either combustion gases or inert gas, to the furnace chamber, optimum circulation of hot combustion gases along the metal to be molten can be realized, while the temperature difference between the heat-transferring medium and the metal to be molten can be small and energy consumption is minimal. The furnace according to the invention allows to obtain a substantial saving in energy, thereby considerably reducing the formation of metal oxide, which in known furnaces used in the aluminum industry may be over 5%.

In the furnace according to the invention, also the temperature in the furnace chamber can be better controlled than in the known furnaces. As a result, the furnace according to the invention can also be used for melting enamelled or oil-contaminated metal, without a pretreatment being required. To this effect, the contaminated metal is first deprived of contaminants at relatively low temperature, the pyrolysis, after which the temperature in the furnace is increased until the desired temperature for further heating and melting of the metal is reached.

According to a preferred embodiment of the invention, there is provided a coupling of two or more substantially identical furnaces, in which the hot gases of the first furnace are for one part recycled to the furnace chamber of that furnace and used for another part, conducted to the furnace chamber of the second furnace, which is used for preheating and, if necessary, for pyrolyzing the metal to be molten.

Coupling two identical furnaces may sometimes give problems, in connection with the duration of the different process steps, in attuning the process steps in the different furnaces to each other; in such a case it may be desirable to couple more than two furnaces. Instead of using several separate furnaces, use may be made of a furnace containing a plurality of compartments in a furnace chamber, with the metal to be molten being pyrolyzed in one compartment, preheated in a second compartment, and the molten metal being maintained in hot condition in a third compartment, the arrangement being such that the heating can always take place either by means of hot gases from the combustion installation, or by liquid metal.

One embodiment of the invention will now be described, by way of example, with reference to the accompanying drawings, in which:

FIG. 1 diagrammatically shows a furnace for melting metal; and

FIG. 2 diagrammatically shows a preferred embodiment according to the invention, in which the means for recycling the combustion gases of two furnaces are coupled to each other.

FIG. 1 shows a furnace chamber 1 wherein the metal to be molten, which may either be metal scrap or pieces of new metal, can be introduced through a door 2. In the furnace chamber terminate a plurality of burners, reference numeral 3 indicating a holding burner and numeral 4 two melting burners. The combustion gases produced during the melting of the metal can escape through a discharge outlet 14 into a conduit 5 which has a left portion defining a stack conduit 16 containing a controllable valve 6 to a stack 7. Between the valve 6 and the stack 7, an after-burner 9 may be provided in stack conduit 16 for after-burning the combustion gases, so that the gases escaping through stack 7 do not pollute the environment.

The right and upward extending portions of the conduit 5 defines a recycle conduit 18 which, adjacent the burners 3, 4, also communicates with the furnace chamber 1, while a fan 8 is incorporated in the recycle conduit 18 for recycling the hot combustion gases to the furnace chamber 1. In or adjacent the conduit 5, there is also provided a pressure gauge 10, gauging the pressure in the furnace chamber and keeping the same at a predetermined value by influencing the position of the valve 6. It will be clear that in a closed position of valve 6, all combustion gases are recycled by the fan 8 to the furnace chamber for heating the metal to be molten. However, when the pressure in the furnace chamber exceeds a predetermined value, the valve 6 is opened to a greater or lesser extent by means of a control signal from gauge 10 in order to maintain the pressure in the furnace chamber at the desired value above atmospheric pressure. Preferably, the fan 8 circulates the combustion gases at a high rate, so as to ensure optimum transfer of heat to the material to be molten.

When for heating the metal, use is made of an inert gas instead of combustion gases, the burners 3 and 4 on the furnace chamber can be dispensed with and instead a heating element is coupled to conduit 5. FIG. 1 shows as an example in dotted lines a heat exchanger 11 which receives a hot medium through conduit 12 for heating the inert gas in conduit 5. When inert gas is used, naturally no combustion gases are produced; however, when contaminated metal is molten, there are produced various fumes which can be discharged by means of the stack 7.

In the section 16 of the conduit 5 between the furnace chamber and the stack 7, there may also be provided a so-called economizer (not shown), which withdraws residual heat from the combustion gases, which heat can be used e.g. for heating water, as a result of which the energetic efficiency of the furnace is further increased.

In melting metal, it is preferable to first pre-heat the metal to be molten to a first temperature, when the metal can be stripped of contaminants e.g. by pyrolysis, and subsequently, to melt the same at a second, higher temperature. The embodiment shown in FIG. 2 is a particularly suitable arrangement for this purpose. As compared with prior furnaces, this arrangement has the advantage that the pre-heated metal need not be transferred from the preheating furnace to the melting furnace proper.

In the embodiment shown in FIG. 2, there are provided to this end two furnaces that are identical to one another and to the furnace shown in FIG. 1. The various parts of the left-hand furnace in FIG. 2 are indicated by the same reference numerals as those of the furnace in FIG. 1, while the parts of the right-hand furnace in FIG. 2 have the same numerals as those of the furnace in FIG. 1, but now with an accent. The function of the various parts is likewise identical to the function of these parts in the furnace shown in FIG. 1. The conduits 5 and 5' for the combustion gases, in the embodiment according to FIG. 2, are interconnected by means of a conduit 20, in which a controllable valve 22 is mounted. The valve 22 is controlled by either pressure gauge 10 or by pressure gauge 10'.

The operation of the furnace shown in FIG. 2 is as follows. It is assumed that at a given moment, in FIG. 2, the left-hand furnace is the melting furnace and the right-hand furnace the preheating furnace. The combustion gases from the melting furnace are circulated by fan 8 through conduit 18 to the furnace chamber 1, while pressure gauge 10 maintains the pressure in the furnace at a predetermined value. Also, valve 22 is controlled by pressure gauge 10, so that the excess combustion gases from furnace chamber 1 can be conducted through conduit 18' by fan 8' to the furnace chamber 1' of the preheating furnace, with valve 6 remaining closed.

In the preheating furnace only burner 3' is burning, which together with the combustion gases from furnace chamber 1 supplied by fan 8' brings the metal in the furnace chamber to the desired preheating temperature. When gauge 10' detects that the pressure in furnace chamber 1' exceeds a predetermined value, said gauge opens the valve 6' by means of a suitable signal, so that a part of the combustion gases can escape through stack 7'. Alternatively, these combustion gases may be conducted through an economizer (not shown) for withdrawing residual heat.

When the metal in furnace chamber 1 has molten, this can be removed from the furnace by means of a drain, not shown, and a fresh quantity of metal to be molten can be introduced in chamber 1. In chamber 1 exclusively the preheating burner 3 is ignited, while in furnace chamber 1' in addition to burner 3, also the melting burners 4' are ignited. Pressure gauge 10' now takes over the control of valve 22, and valve 6' remains closed. Gauge 10 now controls valve 6. The left-hand furnace in FIG. 2 now functions as a preheating furnace, while the right-hand furnace functions as a melting furnace, a part of the combustion gases in conduit 18' being conducted by the fan 8 to furnace chamber 1 by means of conduit 20, and conduit 18 for it to provide for the preheating of the metal in chamber 1, together with burner 3. Due to the construction shown in FIG. 2, it is no longer necessary to transfer the preheated metal to another furnace, while further the residual heat in the combustion gases is optimally used. In particular when contaminated metal is molten preheated and melted, it is desirable that the furnace is hermetically shut off from the outside air and that a given excess pressure above atmospheric pressure is maintained in the furnace by means of the pressure gauge 10. This arrangement ensures that no oxygen is admitted to the incompletely burnt gases produced in the pyrolysis, which otherwise might lead to explosions, and that the combustion gases cannot escape in an uncontrolled manner. Since, in the embodiment shown in FIG. 2, both furnaces are identical to that of FIG. 1, it is possible, if desired, to use either of the furnaces separately when valve 22 is closed. This is for instance of importance in case of repairs or when preheating of the metal to be molten is not necessary.

In the twin furnace construction shown in FIG. 2, it is of course also possible to use inert gas for heating the metal to be molten instead of combustion gases; in that case it is necessary for the conduit 18 and/or 18' to be coupled to a heating element, e.g. a heat exchanger, in the manner shown in FIG. 1.

What I claim:

1. A furnace for sequentially pre-heating and melting a charge of metal, comprising a furnace chamber having at least one closable supply opening for introducing a contaminated charge of metal into the furnace chamber wherein the furnace chamber is adapted for sequential pre-heating and melting cycles for the metal charge, means for discharging gas from the furnace chamber, a recycle conduit connected directly between the gas discharging means and the furnace chamber, a fan incorporated in the recycle conduit for producing a recycle stream of the discharged gas in the recycle conduit directly to the furnace chamber and to the charge therein at a rate sufficient to ensure substantially optimum convection transfer of heat to the metal, heat source means for heating the gas of the recycle stream to a first temperature sufficient to gasify metal contaminants, but insufficient to melt the metal during the pre-heating cycle and to a second temperature sufficient to melt the metal during the melting cycle, a stack, a stack conduit connected between the gas discharging means and the stack, a controllable valve incorporated in the stack conduit, and pressure gauge means responsive to the pressure in the furnace chamber for operating the controllable valve to keep the furnace chamber pressure at a predetermined value.

2. A furnace as claimed in claim 1 wherein the heat source means includes burner means, the gas includes combustion gas, the furnace chamber is hermetically sealable, the predetermined value of furnace chamber pressure is greater than atmospheric pressure, and the stack conduit is connected to the gas discharging means upstream from the fan in the recycle conduit.

3. A furnace arrangement adapted for pre-heating and melting metals, comprising a pair of furnaces adapted for alternate operation in pre-heating and melting modes wherein each furnace includes a furnace chamber having at least one closable supply opening for introducing a charge of contaminated metal to be pre-heated and melted in the furnace chamber, means for discharging gas from the furnace chamber, a recycle conduit connected directly between the gas discharging means and the furnace chamber, a fan incorporated in the recycle conduit for recycling at least a portion of the discharged gas directly to the furnace chamber at a rate sufficient to ensure substantially optimum convection transfer of heat to the metal, heat source means for heating the recycled gas to gasify metal contaminants during the pre-heating mode and to melt the metal during the melting mode, a stack, a stack conduit connected between the gas discharging means and the stack, a controllable stack valve incorporated in the stack conduit, pressure gauge means responsive to the pressure in the furnace chamber for operating the controllable stack valve when the respective furnace is in a pre-heating mode to keep the furnace chamber pressure at a predetermined value, and said controllable stack valve being adapted for closing the stack conduit when the respective furnace is operated in a melting mode;

a connecting conduit between the recycle conduits of the pair of furnaces for conducting excess discharge gas from the recycle conduit of the furnace in the melting mode to the recycle conduit of the furnace in the pre-heating mode; and a controllable connecting valve incorporated in the connecting conduit wherein the controllable connecting valve is adapted for being operated by the pressure gauge means of a furnace in a melting mode to control the pressure in the respective furnace chamber.

4. A furnace arrangement as claimed in claim 3 wherein the heat source means of each furnace includes a plurality of burners wherein only one of the plurality of burners is operated when the respective furnace is in a pre-heating mode and all of the plurality of burners are operated when the respective furnace is in a melting mode, and the discharge gas includes combustion gas.

* * * * *